US006736283B1

(12) United States Patent
Santamaria et al.

(10) Patent No.: US 6,736,283 B1
(45) Date of Patent: May 18, 2004

(54) CAN END, TOOLING FOR MANUFACTURE OF THE CAN END AND SEAMING CHUCK ADAPTED TO AFFIX A CONVERTED CAN END TO A CAN BODY

(75) Inventors: Alejandro J. Santamaria, Export, PA (US); Richard R. Mathabel, Lower Burrell, PA (US); Darl G. Boysel, Delmont, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/300,566

(22) Filed: Nov. 19, 2002

(51) Int. Cl.[7] ..... B21D 51/44; B21D 51/32

(52) U.S. Cl. ..... 220/619; 220/620; 220/623; 413/27; 413/31; 29/243.5

(58) Field of Search ..... 220/619, 620, 220/623, 906, 608; 413/27, 31; 29/243.5

(56) References Cited

U.S. PATENT DOCUMENTS

| | | | | |
|---|---|---|---|---|
| 3,843,014 A | | 10/1974 | Cospen et al. | 220/66 |
| 4,037,550 A | * | 7/1977 | Zofko | 413/6 |
| 4,093,102 A | | 6/1978 | Kraska | 220/67 |
| 4,109,599 A | | 8/1978 | Schultz | 113/121 |
| 4,217,843 A | | 8/1980 | Kraska | 113/121 |
| 4,254,890 A | * | 3/1981 | Westphal | 220/276 |
| 4,448,322 A | | 5/1984 | Kraska | 220/67 |
| 4,606,472 A | | 8/1986 | Taube et al. | 220/66 |
| 4,808,052 A | | 2/1989 | Bulso, Jr. et al. | 413/8 |
| 4,809,861 A | | 3/1989 | Wilkinson et al. | 220/66 |
| 4,813,223 A | | 3/1989 | Nipper et al. | 57/294 |
| 4,891,529 A | | 1/1990 | Braun et al. | 250/560 |
| 4,939,918 A | | 7/1990 | Schoch | 72/20 |
| 4,955,223 A | | 9/1990 | Stodd et al. | 72/336 |
| 4,991,735 A | | 2/1991 | Biondich | 220/600 |
| 5,046,637 A | | 9/1991 | Kysh | 220/610 |
| 5,149,238 A | | 9/1992 | McEldowney et al. | 413/8 |
| 5,582,319 A | | 12/1996 | Heyes et al. | 220/454 |
| 5,685,189 A | | 11/1997 | Nguyen et al. | 72/348 |
| 5,813,812 A | | 9/1998 | Moran et al. | 413/31 |
| 5,823,040 A | | 10/1998 | Stodd | 72/329 |
| 5,857,734 A | | 1/1999 | Okamura et al. | 296/189 |
| 5,911,551 A | | 6/1999 | Moran | 413/31 |
| 5,957,647 A | | 9/1999 | Hinton | 413/4 |
| 6,024,239 A | | 2/2000 | Turner et al. | 220/269 |
| 6,065,634 A | | 5/2000 | Brifcani et al. | 220/619 |
| 6,089,072 A | | 7/2000 | Fields | 72/379.4 |
| 6,102,243 A | | 8/2000 | Fields et al. | 220/619 |
| 6,126,034 A | | 10/2000 | Borden et al. | 220/671 |
| 6,290,447 B1 | | 9/2001 | Siemonsen et al. | 413/56 |
| 6,330,954 B1 | | 12/2001 | Turner et al. | 220/269 |
| 6,408,498 B1 | | 6/2002 | Fields et al. | 29/243.5 |
| 6,419,110 B1 | | 7/2002 | Stodd | 220/623 |
| 6,460,723 B2 | * | 10/2002 | Nguyen et al. | 220/619 |
| 6,516,968 B2 | * | 2/2003 | Stodd | 220/623 |

FOREIGN PATENT DOCUMENTS

| | | |
|---|---|---|
| JP | 2544222 | 4/1989 |
| WO | 98/34743 | 8/1998 |
| WO | 01/41948 | 6/2001 |
| WO | 02/43895 | 6/2002 |
| WO | 02/057148 | 7/2002 |

OTHER PUBLICATIONS

Zonker et al U.S. Ser. No. 10/033,257, filed Dec. 27, 2001.

* cited by examiner

*Primary Examiner*—Joseph Man-Fu Moy
(74) *Attorney, Agent, or Firm*—David P. Maivald

(57) ABSTRACT

A can end is provided that has a three part chuck wall. The first chuck wall has an angle of 20 degrees to 35 degrees as measured from an axis perpendicular to the can end. The second chuck wall has an angle of 4 degrees to 27 degrees as measured from the axis. The third chuck wall has an angle of 18 degrees to 32 degrees as measured from the axis. Tooling adapted to manufacture the can end is also provided. Additionally, a seaming chuck is provided that has a recess that is adapted to avoid contact with radii of curvature along the chuck wall during seaming of the can end to a can body.

23 Claims, 3 Drawing Sheets

CAN END, TOOLING FOR MANUFACTURE OF THE CAN END AND SEAMING CHUCK ADAPTED TO AFFIX A CONVERTED CAN END TO A CAN BODY

FIELD OF THE INVENTION

The present invention relates to can ends, tooling used in a press that is adapted to manufacture the can end and a seaming chuck adapted to hold and rotate a converted can end to be secured to a can body.

BACKGROUND OF THE INVENTION

Beverage containers and more specifically metallic beverage cans are typically manufactured by affixing a can end to a can body. In some applications, two ends may be affixed on a top side and a bottom side of a can body. More frequently, a can end is affixed to a top end of a can body, which is drawn and wall ironed ("DWI") from a flat sheet of blank material such as aluminum. Due to the potentially high internal pressures generated by carbonated beverages, both the can body and the can end are typically required to sustain internal pressures of 90 psi without catastrophic and permanent deformation. Further, depending on various environmental conditions such as heat, over fill, high carbon dioxide content, and vibration, the internal pressure in a beverage may exceed internal pressures of 90 psi. Recently, can end developments have been focused on engineering various features of the can end including the chuck wall angle in order to reduce the aluminum content in the can end and allow the can end to sustain internal pressures exceeding 90 psi. Examples of these developments can be found in WO 98/34743, WO 02/43895 and WO 02/057148.

As can be seen from the prior art, can end manufacturers have been focusing their attention on engineering various features of the can end including the various angles of the can end chuck wall. Also, can ends must be durable to withstand high internal pressures, and be manufactured with extremely thin materials such as aluminum to decrease the overall cost of the manufacturing process and weight of the finished product. Accordingly, there continuously exists a need for a durable can end, which can withstand the high internal pressures created by carbonated beverages, and the external forces applied during shipping, yet, which is made from durable, lightweight and extremely thin metallic materials. The following patent application describes an improved can end with a unique overall geometry from the prior art that is adapted to be affixed to a standard can body. Additionally, certain configurations of the chuck wall reduce the risk of failure along the chuck wall. The improved can end reduces material usage and will withstand typical internal beverage container pressures. Tooling used to manufacture the improved beverage can end is also described in the patent application.

It has also been found that during the seaming operation of a can end to a can body significant contact of the seaming chuck with the chuck wall can lead to deformation of the chuck wall. In those can ends that have several chuck wall angles, it is important to eliminate deformation of the radii of curvature between the various chuck wall portions to maintain the overall geometry of the can end. Accordingly, there exists a need for a seaming chuck that does not engage the entire chuck wall during the seaming operation of a can end to a can body. The following patent application also describes an improved seaming chuck that engages a portion of the chuck wall and the countersink during a conventional seaming operation of a can end to a standard can body.

SUMMARY OF THE INVENTION

It is an object of the invention to provide a can end with a unique geometry.

It is another object of the invention to provide a can end with reduced metal content than the majority of currently available can ends.

It is another object of the invention to provide a can end with certain chuck wall geometries that reduces the risk of catastrophic failure of the can end in the presence of excessive internal pressure within a beverage container.

It is another object of the invention to provide tooling that is adapted to manufacture the can end.

It is another object of the invention to provide a seaming chuck that has a recess that avoids deforming radii of curvature in the chuck wall of the can end.

Certain objects of the invention are obtained by providing a can end that is adapted to be affixed to a can body. The can end has a central panel integrally connected to an inner panel wall, and the connection has a first radius of curvature. A countersink is integrally connected to the inner panel wall, and the countersink has a second radius of curvature. A chuck wall is integrally connected to the countersink, and the chuck wall has three chuck wall sections. A first chuck wall is integrally connected to the countersink, and the first chuck wall has an angle $\theta_1$ of 20 degrees to 35 degrees as measured from an axis perpendicular to the central panel. A second chuck wall is integrally connected to the first chuck wall, the second chuck wall has an angle $\theta_2$ of 4 degrees to 27 degrees as measured from the axis, and the connection has a third radius of curvature. A third chuck wall is integrally connected to the second chuck wall, the third chuck wall has an angle $\theta_3$ of 18 degrees to 32 degrees as measured from the axis, and the connection has a fourth radius of curvature. An end wall is integrally connected to the third chuck wall, the end wall is adapted to be affixed to a flange of a can body, and the can end has a preselected panel depth and a preselected countersink depth. Other objects of the invention are obtained by providing tooling that is adapted to manufacture the can end previously described. Other objects of the invention are obtained by providing a seaming chuck that is adapted to avoid engagement with portions of the chuck wall and the third radius of curvature and the fourth radius of curvature of the can end previously described.

DETAILED DESCRIPTION OF PREFERRED EMBODIMENTS

Figure 1:
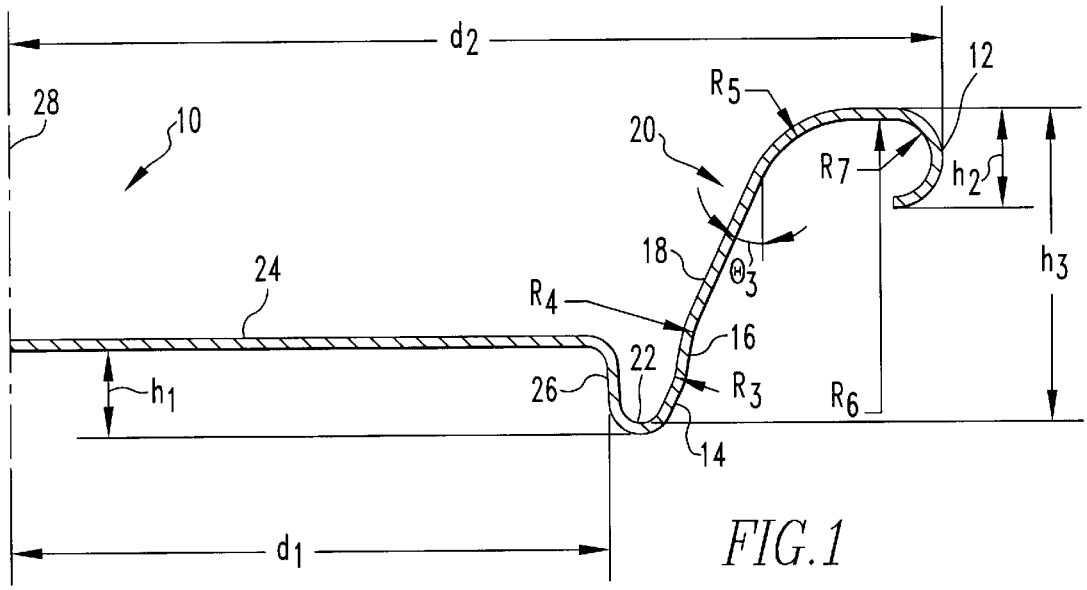
FIG. 1 is a cross sectional view of a can end of the invention.
Figure 2:
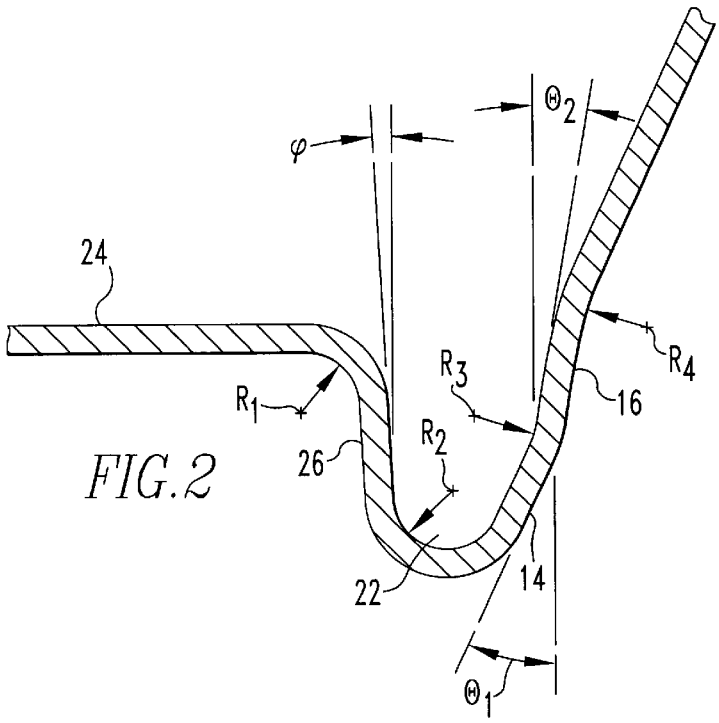
FIG. 2 is an enlarged cross sectional view of the countersink of the invention.

Referring now to FIGS. 1–2, a cross sectional front elevational view of the invention is provided. A can end 10 is shown that has a circular end wall 12, a chuck wall 20, a countersink 22, a central panel 24 and an inner panel wall 26 that connects the countersink 22 to the central panel 24. The chuck wall 20 is divided into a first chuck wall 14, a second chuck wall 16 and a third chuck wall 18. The first chuck wall 14, second chuck wall 16 and third chuck wall 18 each have an angle of inclination $\theta_1$, $\theta_2$, $\theta_3$ respectively with respect to an axis 28 perpendicular to the central panel 24. As noted, the central panel 24 is connected to the countersink 22 by the inner panel wall 26. The inner panel wall 26 can have an angle of inclination, $\phi$ with respect to the axis 28 of about 0° to 5°. The transition from the central panel 24 to the inner panel wall 26 has a radius of curvature, $R_1$. $R_1$ may have a length of about 0.010 inches to 0.020 inches. In FIG. 2, $R_1$ is shown with a length of 0.015 inches. The countersink 22 has a radius of curvature, $R_2$. $R_2$ may have a length of about 0.010 inches to 0.020 inches. In FIG. 2, $R_2$ is shown with a length of 0.015 inches. The countersink 22 is connected to the first chuck wall 14, which has an angle of $\theta_1$. $\theta_1$ may have an angle of about 20° to 35° and preferably about 20° to 30°. In FIG. 2, $\theta_1$ is shown with an angle of 25°. The first chuck wall 14 is connected to second chuck wall 16. The transition from the first chuck wall 14 to the second chuck wall 16 has a radius of curvature, $R_3$. $R_3$ may have a length of about 0.040 inches to 0.080 inches. In FIGS. 1–2, $R_3$ is shown with a length of 0.060 inches. The second chuck wall 16 has an angle $\theta_2$ that may have an angle of about 4° to 27°, and preferably about 5° to 15°. In FIG. 2, $\theta_2$ is shown with an angle of 12°. The second chuck wall 16 is connected to the third chuck wall 18. The transition from the second chuck wall 16 to the third chuck wall 18 has a radius of curvature, $R_4$. $R_4$ may have a length of about 0.040 inches to 0.120 inches and preferably about 0.060 inches to 0.100 inches. In FIGS. 1–2, $R_4$ is shown with a length of 0.080 inches. The third chuck wall 18 has an angle $\theta_3$ that may have an angle of about 18° to 32° and preferably about 20° to 27°. In FIG. 1, $\theta_3$ is shown with an angle of 24.5°. The third chuck wall 18 transitions to end wall 12 through three different radii of curvature, $R_5$ through $R_7$. $R_5$ may have a length of about 0.068 inches to 0.082 inches. In FIG. 1, $R_5$ is shown with a length of 0.070 inches. $R_6$ may have a length of about 0.217 inches to 0.221 inches. In FIG. 1, $R_6$ is shown with a length of 0.219 inches. $R_7$ may have a length of about 0.025 inches to 0.035 inches. In FIG. 1, $R_7$ is shown as having a length of 0.030 inches.

While FIGS. 1–2 display a size 202 diameter can end 10, the present invention would be equally applicable to other diameter can ends as well. The invention would most likely be used in connection with 200, 202, 204 and 206 diameter can ends. The numbers 200, 202, 204 and 206 refer to industry standard designations for the diameter of can ends. For example, a 202 diameter can end is equivalent to a 2 and 2/16 inch diameter after the can end is seamed onto a can body. A 204 diameter can end is equivalent to a 2 and 4/16 inch diameter after the can end is seamed onto a can body. Panel diameter, $d_1$ may have a length of about 1.80 inches to 1.84 inches and preferably about 1.815 inches to 1.825 inches. In FIG. 1, $d_1$ is shown with a length of 1.82 inches. As can be appreciated, the length of $d_1$ could decrease for 200 diameter can ends or increase for 204 and 206 diameter can ends. Curl diameter, $d_2$ may have a length of about 2.330 inches to 2.345 inches. In FIG. 1, $d_2$ is shown with a length of 2.334 inches. As can be appreciated, the length of $d_2$ could decrease for 200 diameter can ends or increase for 204 and 206 diameter can ends.

The panel depth, $h_1$ may have a height of about 0.060 inches to 0.080 inches and preferably about 0.065 inches to 0.075 inches. In FIG. 1 $h_1$ is shown with a height of 0.075 inches. Curl height, $h_2$ may have a height of about 0.077 inches to 0.082 inches. In FIG. 1, $h_2$ is shown with a height of 0.79 inches. Countersink depth, $h_3$ may have a height of about 0.235 inches to 0.250 inches and preferably about 0.240 inches to 0.245 inches. In FIG. 1, $h_3$ is shown with a height of 0.241 inches.

Table 1 provides examples of can ends 10 with various $\theta_1$ angles that can fall within the scope of the invention. While the examples in Table 1 vary in $\theta_1$ by increments of 2° or 3°, it should be noted that $\theta_1$ may have a value anywhere between 20° to 35°.

TABLE 1

Examples of $\theta_1$ Dimensions for 202 Diameter Can Ends

| Example | $\theta_1$ | $\theta_2$ | $\theta_3$ | $\psi$ |
|---|---|---|---|---|
| 1-1 | 20° | 12° | 25° | 1° |
| 2-1 | 22° | 12° | 25° | 1° |
| 3-1 | 24° | 12° | 25° | 1° |
| 4-1 | 26° | 12° | 25° | 1° |
| 5-1 | 28° | 12° | 25° | 1° |
| 6-1 | 30° | 12° | 25° | 1° |
| 7-1 | 32° | 12° | 25° | 1° |
| 8-1 | 35° | 12° | 25° | 1° |

Table 2 provides examples of can ends 10 with various $\theta_2$ angles that can fall within the scope of the invention. While the examples in Table 2 vary in $\theta_2$ by increments of 3° or 4°, it should be noted that $\theta_2$ may have a value anywhere between 4° to 27°.

TABLE 2

Examples of $\theta_2$ Dimensions for 202 Diameter Can Ends

| Example | $\theta_1$ | $\theta_2$ | $\theta_3$ | $\psi$ |
|---|---|---|---|---|
| 1-2 | 25° | 4° | 25° | 1° |
| 2-2 | 25° | 8° | 25° | 1° |
| 3-2 | 25° | 12° | 25° | 1° |
| 4-2 | 25° | 16° | 25° | 1° |
| 5-2 | 25° | 20° | 25° | 1° |
| 6-2 | 25° | 24° | 25° | 1° |
| 7-2 | 25° | 27° | 25° | 1° |

Table 3 provides examples of can ends 10 with various $\theta_3$ angles that can fall within the scope of the invention. While the examples in Table 3 vary in $\theta_3$ by increments of 2°, it should be noted that $\theta_3$ may have a value anywhere between 18° to 32°.

TABLE 3

Examples of $\theta_3$ Dimensions for 202 Diameter Can Ends

| Example | $\theta_1$ | $\theta_2$ | $\theta_3$ | $\psi$ |
|---|---|---|---|---|
| 1-3 | 25° | 12° | 18° | 1° |
| 2-3 | 25° | 12° | 20° | 1° |
| 3-3 | 25° | 12° | 22° | 1° |
| 4-3 | 25° | 12° | 24° | 1° |
| 5-3 | 25° | 12° | 26° | 1° |
| 6-3 | 25° | 12° | 28° | 1° |
| 7-3 | 25° | 12° | 30° | 1° |
| 8-3 | 25° | 12° | 32° | 1° |

Table 4 provides examples of can ends 10 with various $\phi$ angles that can fall within the scope of the invention. While the examples in Table 4 vary in $\phi$ by increments of 1°, it should be noted that $\phi$ may have a value anywhere between 0° to 5°.

TABLE 4

Examples of ψ Dimensions for 202 Diameter Can Ends

| Example | $\theta_1$ | $\theta_2$ | $\theta_3$ | ψ |
|---|---|---|---|---|
| 1-4 | 25° | 12° | 25° | 0° |
| 2-4 | 25° | 12° | 25° | 1° |
| 3-4 | 25° | 12° | 25° | 2° |
| 4-4 | 25° | 12° | 25° | 3° |
| 5-4 | 25° | 12° | 25° | 4° |
| 6-4 | 25° | 12° | 25° | 5° |

In Tables 1–4, it should be noted that the examples may have a: (1) $\theta_1$ between 20° to 35° or any value within that range; (2) $\theta_2$ between 4° to 27° or any value within that range; (3) $\theta_3$ between 18° to 32° or any value within that range; (4) ϕ between 0° to 5° or any value within that range; (5) $R_1$ length between 0.010 inches to 0.020 inches or any value within that range; (6) $R_2$ length between 0.010 inches to 0.020 inches or any value within that range; (7) $R_3$ length between 0.040 inches to 0.080 inches or any value within that range; (8) $R_4$ length between 0.040 to 0.120 inches or any value within that range; (9) $R_5$ length between 0.068 inches to 0.082 inches or any value within that range; (10) $R_6$ length between 0.217 inches to 0.221 inches or any value within that range; (11) $R_7$ length between 0.025 inches to 0.035 inches or any value within that range; (12) $h_1$ depth between 0.060 to 0.080 inches or any value within that range; (13) $h_2$ height between 0.077 inches to 0.082 inches or any value within that range; and (14) $h_3$ depth between 0.235 inches to 0.250 inches or any value within that range.

On the average, the overall geometry of the can end of the present invention has been found to utilize around 7.1 % less metal than the majority of currently available can ends. As can be appreciated, a can end manufacturer that utilizes the present invention would realize substantial monetary savings by reducing the amount of end stock that is needed to manufacture a can end. Additionally, a certain chuck wall geometry of the can end 10 of the present invention has been found to reduce the risk of catastrophic failure along the chuck wall in the presence of excessive internal pressure within a beverage container. Such a feature is an improvement over prior art can ends that are susceptible to catastrophic failure along the chuck wall. An example of a can end 10 geometry that has been found to reduce the risk of failure along the chuck wall is as follows: $\theta_1$ is about 25°, $\theta_2$ is about 12°, $\theta_3$ is about 24.5°, $R_1$ is about 0.015 inches, $R_2$ is about 0.015 inches, $R_3$ is about 0.060 inches, $R_4$ is about 0.080 inches, $h_1$ is about 0.075 inches, $h_2$ is about 0.79 inches, and $h_3$ is about 0.241 inches. As can be appreciated, there may be other can end 10 geometries that fall within the scope of the present invention that have an overall geometry that will reduce the risk of catastrophic failure along the chuck wall as well.

With regard to the embodiments discussed herein, the improved strength characteristics and reduced costs associated with the can ends are obtained based on the geometric configurations of the can end, the tooling adapted to manufacture the can end and the seaming operation of the can end to a can body. The can ends are typically manufactured from metallic materials such as steel alloys and aluminum alloys. More commonly, the can ends are manufactured from aluminum alloys such as 5182H19, 5182H48, 5182H481 or 5019AH48, which are commonly known in the art. With regard to the thickness of these aluminum alloys, typically a gauge of between about 0.0080 inches to 0.0110 inches is used, with greater thicknesses required for larger diameter can ends. For example, a 200 or 202 diameter can end may utilize an aluminum alloy with a thickness of about 0.0075 inches to 0.0090 inches. A 204 diameter can end may use an aluminum alloy with a thickness of about 0.0085 inches to 0.0095 inches and a 206 diameter can end may use an aluminum alloy with a thickness of about 0.0090 inches to 0.0120 inches.

Figure 3:
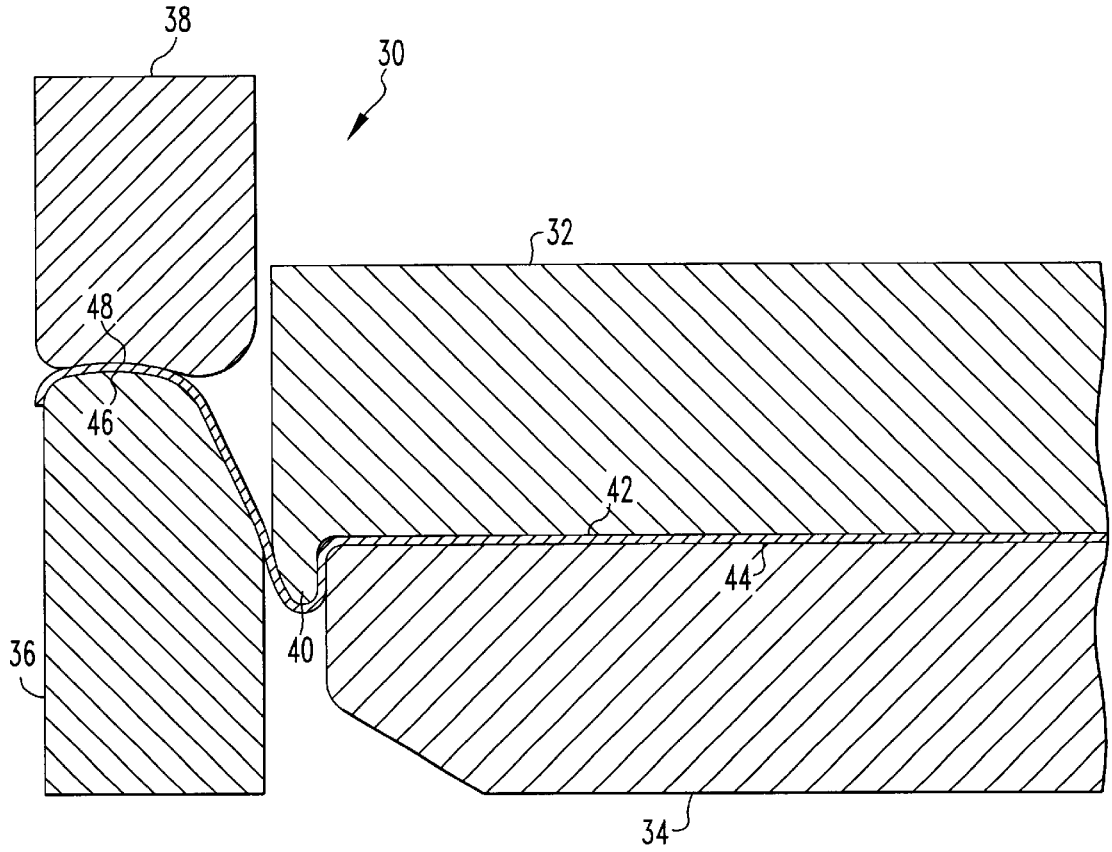
FIG. 3 is a cross sectional view of the tooling adapted to manufacture the can end of the invention.

Having described the can end 10 of the invention, FIG. 3 shows an example of tooling 30 that is affixed to a standard shell press that is commercially available in the beverage container industry. As can be appreciated, other tooling could be developed to be affixed to other commercially available shell presses, and the tooling 30 of FIG. 3 is only shown as an example of the tooling 30 that can be used to manufacture the can end 10. The tooling 30 consists of a die center 32, a die core 34, a die core ring 36 and a pressure ring 38 that are adapted to manufacture the can end 10 described herein with a single stroke of the shell press. The die center 32 is slidably disposed within the pressure ring 38 and has a projection 40 that is adapted to form the countersink 22 and the first chuck wall 14 of the can end 10 during actuation of the shell press. The projection 40 extends outwardly from a generally planar surface 42 of the die center 32. The die core 34 also has generally planar surface 44. The planar surfaces 42 and 44 of the die center 32 and die core 34 are adapted to cooperate with each other during actuation of the shell press to form the central panel 24 of the can end 10. The die core ring 36 has a surface 46 and the pressure ring 38 also has a surface 48. The surfaces 46 and 48 of the die core ring 36 and the pressure ring 38 are adapted to cooperate with each other during actuation of the shell press to form the end wall of the can end 10 prior to curling. The surface 46 of the die core ring 36 is also adapted to form the third chuck wall 18 during actuation of the shell press. The second chuck wall 16 is formed between the first chuck wall 14 and third chuck wall 18 without engagement by the tooling 30 during actuation of the shell press.

After the can end 10 is formed with the tooling 30 of the invention, the end wall is typically curled by techniques well known in the art to yield the resultant end wall 12 as shown in FIG. 1. After curling, the can end 10 is lined in a compound liner apparatus. The compound is adhered to the non-public surface of the end wall 12 of the can end 10 to assist in sealing the can end 10 to a can body during the seaming of the can end 10 to a can body. The compound is typically cured prior to seaming of the can end 10 to a can body. Next, the can end 10 is typically conveyed to a standard conversion press that is commercially available in the beverage container industry to convert the can end 10 into an easy open end ("EOE") with a stay on tab.

In the manufacture of an EOE, the can end 10 is conveyed to a conversion press. In the industry, a pre-converted can end is commonly referred to as a shell. In the typical operation of a conversion press, the can end 10 is introduced between an upper tool member and a lower tool member, which are in the open, spaced apart position. A press ram advances the upper tool member toward the lower tool member in order to perform any of a variety of tooling operations such as rivet forming, paneling, scoring, embossing, and final staking. After performing a tooling operation, the press ram retracts until the upper tool member and lower tool member are once again in the open, spaced apart position. The partially converted can end 10 is transported to the next successive tooling operation until an EOE is completely formed and discharged from the press. As one shell leaves a given tooling operation, another shell is introduced to the vacated operation, thus continuously repeating the entire EOE manufacturing process. Examples of EOEs can be found in U.S. Pat. Nos. 4,465,204 and 4,530,631. For the sake of being concise, a figure showing the can end 10 after conversion has been omitted it being understood that a top plan view of the EOE would be similar in appearance to the EOE displayed in U.S. Pat. Nos. 4,465,204 and 4,530,631. Also, in an alternate embodiment of the invention, the unique overall geometry of the can end 10 of the present invention may be partially formed in a shell press and finally formed in the conversion press to yield the can end 10 of the present invention.

Figure 4:
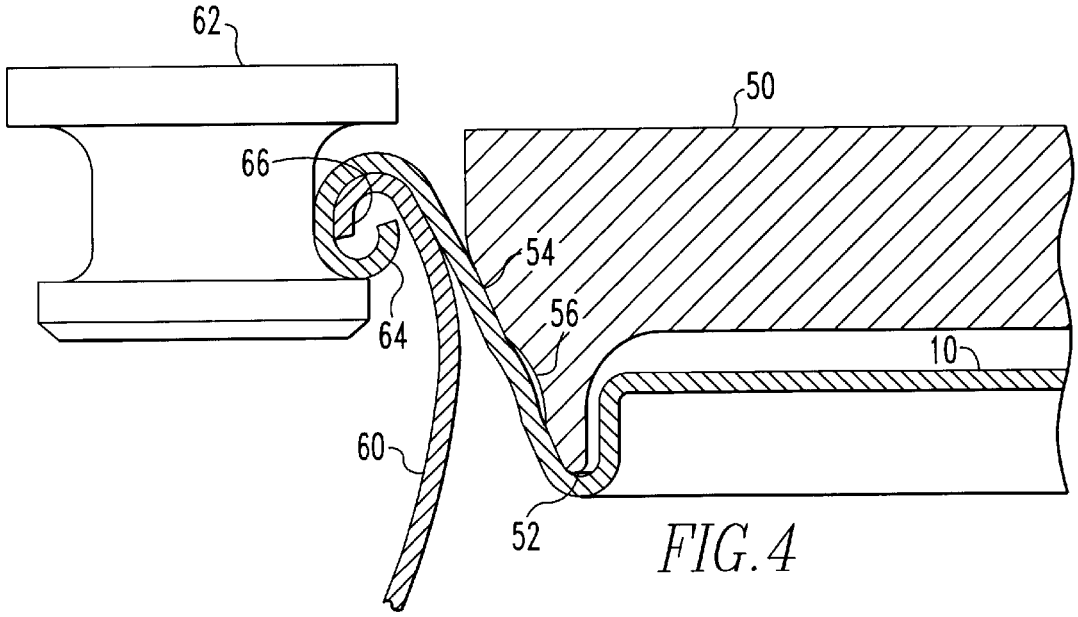
FIG. 4 is a cross sectional view of the roller and the seaming chuck adapted to seam the converted can end of the invention to a can body.

After conversion of the can end 10, the can end 10 is ready to be seamed to a can body 60 as shown in FIG. 4. It should be noted that FIG. 4 is not drawn to scale it being noted that FIG. 4 is included for illustrative purposes of the seaming operation. In FIG. 4, it should also be noted for simplicity that the can end 10 is not displayed as being converted into an EOE it being understood that those features were intentionally omitted. A seaming chuck 50 is shown that has a projection 52 that is adapted to engage a portion of the countersink 22 and a portion of the first chuck wall 14. The seaming chuck 50 also has a surface 54 that is adapted to engage a portion of the third chuck wall 18. The seaming chuck 50 additionally has a recess 56 that is adapted to avoid engagement with portions of the chuck wall 20 and the radii of curvature, $R_3$ and $R_4$. The seaming chuck 50 has the advantage of the recess 56 avoiding contact with the radii of curvature, $R_3$ and $R_4$. Eliminating this contact prevents $R_3$ and $R_4$ from being deformed during the seaming operation. Avoiding alteration of $R_3$ and $R_4$ maintains the integrity of these transition points and the properties of the can end 10.

Figure 5:
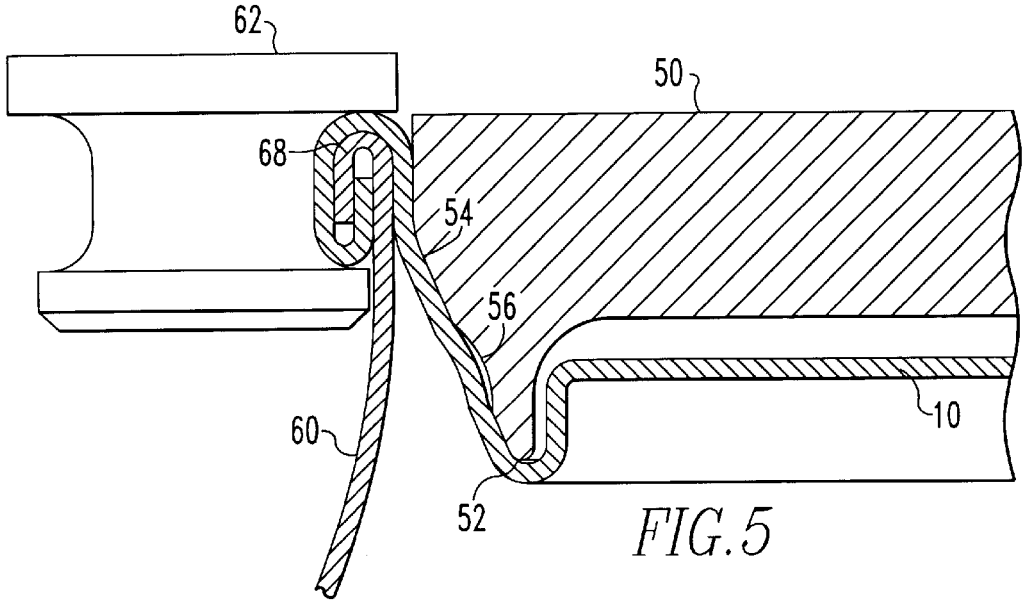
FIG. 5 is a cross sectional view of the roller and the seaming chuck showing the converted can end of the invention seamed to a can body.

FIG. 4 shows the initial stage of double seam formation between can end 10 and a can body 60. A roller 62 exerts force against the peripheral curl portion 64 of the can end 10, which bears the can end 10 against the seaming chuck 50. The seaming chuck 50 uses projection 52 and surface 54 to drive the can end 10 and can body 60 to rotate. The seaming operation generates a rolling action that reforms the peripheral curl portion 64 and flange 66 to form a double seam 68 as shown in FIG. 5. It should be noted that FIG. 5 is not drawn to scale it being noted that FIG. 5 is included for illustrative purposes of the seaming operation. In FIG. 5, it should also be noted for simplicity that the can end 10 is not displayed as being converted into an EOE it being understood that those features were intentionally omitted.

Having described the presently preferred embodiments of the invention, it is to be understood that the invention may be otherwise embodied within various functional equivalents within the scope of the appended claims.

What is claimed is:

1. A can end adapted to be affixed to a can body, the can end comprising:

(a) a central panel integrally connected to an inner panel wall, the connection having a first radius of curvature;

(b) a countersink integrally connected to the inner panel wall, the countersink having a second radius of curvature;

(c) a chuck wall integrally connected to the countersink, the chuck wall having three chuck wall sections;

(d) a first chuck wall integrally connected to the countersink; the first chuck wall having an angle $\theta_1$ of 20 degrees to 35 degrees as measured from an axis perpendicular to the central panel;

(e) a second chuck wall integrally connected to the first chuck wall, the second chuck wall having an angle $\theta_2$ of 4 degrees to 27 degrees as measured from the axis, the connection having a third radius of curvature;

(f) a third chuck wall integrally connected to the second chuck wall, the third chuck wall having an angle $\theta_3$ of 18 degrees to 32 degrees as measured from the axis, the connection having a fourth radius of curvature; and (g) an end wall integrally connected to the third chuck wall, the end wall being adapted to be affixed to a flange of a can body, the can end having a preselected panel depth and a preselected countersink depth.

2. The can end of claim 1 wherein the ratio of the length of the first radius of curvature to the length of the second radius of curvature is 50% or greater.

3. The can end of claim 1 wherein the ratio of the length of the third radius of curvature to the length of the fourth radius of curvature is 33% or greater.

4. The can end of claim 1 wherein the ratio of the panel depth to the unit depth is 24% or greater.

5. The can end of claim 1 wherein the first radius of curvature has a length of about 0.010 inches to 0.020 inches.

6. The can end of claim 1 wherein the second radius of curvature has a length of about 0.010 inches to 0.020 inches.

7. The can end of claim 1 wherein the third radius of curvature has a length of about 0.040 inches to 0.080 inches.

8. The can end of claim 1 wherein the fourth radius of curvature has a length of about 0.040 inches to 0.120 inches.

9. The can end of claim 1 wherein the panel depth is about 0.060 inches to 0.080 inches.

10. The can end of claim 1 wherein the countersink depth is about 0.235 inches to 0.250 inches.

11. The can end of claim 1 wherein the inner panel wall has an angle $\phi$ of 0 degrees to 5 degrees as measured from the axis.

12. The can end of claim 1 wherein the can end utilizes over 6 percent less metal than a conventional can end.

13. The can end of claim 1 wherein the can end has a preselected geometry that reduces the risk of catastrophic failure of the can end in the presence of excessive internal pressure within a beverage container.

14. Tooling adapted to manufacture a can end to be affixed to a can body, the can end comprising:

(a) a central panel integrally connected to an inner panel wall, the connection having a first radius of curvature;

(b) a countersink integrally connected to the inner panel wall, the countersink having a second radius of curvature;

(c) a chuck wall integrally connected to the countersink, the chuck wall having three chuck wall sections;

(d) a first chuck wall integrally connected to the countersink; the first chuck wall having an angle $\theta_1$ of 20 degrees to 35 degrees as measured from an axis perpendicular to the central panel;

(e) a second chuck wall integrally connected to the first chuck wall, the second chuck wall having an angle $\theta_2$ of 4 degrees to 27 degrees as measured from the axis, the connection having a third radius of curvature;

(f) a third chuck wall integrally connected to the second chuck wall, the third chuck wall having an angle $\theta_3$ of 18 degrees to 32 degrees as measured from the axis, the connection having a fourth radius of curvature; and (g) an end wall integrally connected to the third chuck wall, the end wall being adapted to be affixed to a flange of a can body, the can end having a preselected panel depth and a preselected countersink depth.

15. The can end of claim 14 wherein the ratio of the length of the first radius of curvature to the length of the second radius of curvature is 50% or greater.

16. The can end of claim 14 wherein the ratio of the length of the third radius of curvature to the length of the fourth radius of curvature is 33% or greater.

17. The can end of claim 14 wherein the ratio of the panel depth to the unit depth is 24% or greater.

18. The can end of claim 14 wherein the first radius of curvature has a length of about 0.010 inches to 0.020 inches, the second radius of curvature has a length of about 0.010 inches to 0.020 inches, the third radius of curvature has a length of about 0.040 inches to 0.080 inches, and the fourth radius of curvature has a length of about 0.040 inches to 0.120 inches.

19. The can end of claim 14 wherein the panel depth is about 0.060 inches to 0.080 inches and the countersink depth is about 0.235 inches to 0.250 inches.

20. A seaming chuck adapted to seam a can end to a can body, the can end comprising:

(a) a central panel integrally connected to an inner panel wall, the connection having a first radius of curvature;

(b) a countersink integrally connected to the inner panel wall, the countersink having a second radius of curvature;

(c) a chuck wall integrally connected to the countersink, the chuck wall having three chuck wall sections;

(d) a first chuck wall integrally connected to the countersink;

(e) a second chuck wall integrally connected to the first chuck wall, the connection having a third radius of curvature;

(f) a third chuck wall integrally connected to the second chuck wall, the connection having a fourth radius of curvature; and (g) an end wall integrally connected to the third chuck wall, the end wall being adapted to be affixed to a flange of a can body, the can end having a preselected panel depth and a preselected countersink depth, wherein the seaming chuck comprises:

(aa) a projection that is adapted to engage a portion of the countersink and a portion of the first chuck wall;

(bb) a surface that is adapted to engage a portion of the third chuck wall; and (cc) a recess that is adapted to avoid engagement with portions of the chuck wall, the third radius of curvature and the fourth radius of curvature.

21. The can end of claim 20 wherein the ratio of the length of the first radius of curvature to the length of the second radius of curvature is 50% or greater.

22. The can end of claim 20 wherein the ratio of the length of the third radius of curvature to the length of the fourth radius of curvature is 33% or greater.

23. The can end of claim 20 wherein the ratio of the panel depth to the countersink depth is 24% or greater.

* * * * *